US008661737B1

(12) United States Patent
Brogan

(10) Patent No.: US 8,661,737 B1
(45) Date of Patent: Mar. 4, 2014

(54) DOOR SEALING DEVICE AND RELATED METHODS

(75) Inventor: John Brogan, Peoria, AZ (US)

(73) Assignee: Unique Home Designs, Inc., Gilbert, AZ (US)

( * ) Notice: Subject to any disclaimer, the term of this patent is extended or adjusted under 35 U.S.C. 154(b) by 377 days.

(21) Appl. No.: 12/886,498

(22) Filed: Sep. 20, 2010

Related U.S. Application Data

(60) Provisional application No. 61/243,732, filed on Sep. 18, 2009.

(51) Int. Cl.
*E06B 1/70* (2006.01)

(52) U.S. Cl.
USPC ..... 49/467; 49/501

(58) Field of Classification Search
USPC ..... 49/501, 467; 52/217, 656.4, 656.6, 52/656.7, 656.8, 645
See application file for complete search history.

(56) References Cited

U.S. PATENT DOCUMENTS

| | | | | | |
|---|---|---|---|---|---|
| 958,481 | A * | 5/1910 | Drinkwater | 160/104 |
| 2,262,800 | A * | 11/1941 | Farmer | 160/223 |
| 2,589,878 | A * | 3/1952 | Shapiro | 292/60 |
| 3,710,839 | A * | 1/1973 | Andres | 160/372 |
| 3,738,062 | A * | 6/1973 | Ughi | 49/55 |
| 4,026,070 | A * | 5/1977 | Hicks | 49/55 |
| 4,031,665 | A * | 6/1977 | Abramson | 49/501 |
| 4,263,747 | A * | 4/1981 | Coltrin et al. | 49/56 |
| 4,319,431 | A * | 3/1982 | Siers | 49/426 |
| 4,400,911 | A * | 8/1983 | Bell et al. | 49/55 |
| 4,475,309 | A * | 10/1984 | Porter | 49/55 |
| 4,615,142 | A * | 10/1986 | Reeves | 49/55 |
| 4,731,952 | A * | 3/1988 | Mascotte | 49/380 |
| 4,825,610 | A * | 5/1989 | Gasteiger | 52/217 |
| 4,856,230 | A * | 8/1989 | Slocomb | 49/504 |
| 4,922,659 | A * | 5/1990 | Muccioli | 49/501 |
| 4,986,034 | A * | 1/1991 | Mozuras et al. | 49/505 |
| 5,038,538 | A * | 8/1991 | Rozon | 52/213 |
| 5,168,669 | A * | 12/1992 | Knapp | 49/482.1 |
| 5,431,211 | A * | 7/1995 | Guillemet | 160/381 |
| 5,465,532 | A * | 11/1995 | Varin | 49/493.1 |
| 5,575,321 | A * | 11/1996 | Currier | 160/90 |
| 5,609,002 | A * | 3/1997 | Fernandez | 52/507 |
| 5,716,041 | A * | 2/1998 | Groves | 256/73 |
| 5,797,218 | A * | 8/1998 | Holland | 49/55 |
| 5,803,653 | A * | 9/1998 | Zuffetti | 403/363 |
| 5,910,076 | A * | 6/1999 | Gladney | 49/55 |
| 5,943,832 | A * | 8/1999 | Russell | 52/202 |
| 6,079,169 | A * | 6/2000 | Ashworth | 52/217 |
| 6,374,545 | B1 * | 4/2002 | Baczuk | 49/470 |
| 6,378,250 | B1 * | 4/2002 | Yen | 49/470 |
| 6,427,396 | B1 * | 8/2002 | Harrison | 52/202 |
| 6,434,787 | B2 * | 8/2002 | Muller Carranza | 16/4 |
| 6,481,179 | B2 * | 11/2002 | Zen | 52/784.13 |
| 6,658,808 | B1 * | 12/2003 | Doherty et al. | 52/580 |

(Continued)

*Primary Examiner* — Katherine Mitchell
*Assistant Examiner* — Justin Rephann
(74) *Attorney, Agent, or Firm* — Booth Udall Fuller, PLC

(57) ABSTRACT

A kit, door and method of installing an adjustable horizontal adapter bar for a storm, security, screen or other door to a building involves adjustment of a bar for a bottom or a top edge of a door to get a better fit than a standard door. Adjustable bars may comprise multiple telescoping parts, adjustable width vertical bars and fasteners for coupling the adjustable bar to a door. A kit may further comprise a threshold plate and a bug sweep for further resisting entry of bugs small animals and debris to create a better seal.

12 Claims, 4 Drawing Sheets

(56) References Cited

U.S. PATENT DOCUMENTS

| | | | | |
|---|---|---|---|---|
| 7,024,820 | B1 * | 4/2006 | Dustin | 49/168 |
| 7,114,293 | B2 * | 10/2006 | Purlee | 49/470 |
| 7,159,361 | B1 * | 1/2007 | Hale, Jr. | 49/169 |
| 7,549,252 | B2 * | 6/2009 | Vaughn | 49/466 |
| 7,937,904 | B2 * | 5/2011 | Davies | 52/656.1 |
| 8,028,489 | B1 * | 10/2011 | Lawrence | 52/656.7 |
| 2003/0106269 | A1 * | 6/2003 | Bauman et al. | 49/467 |
| 2003/0213204 | A1 * | 11/2003 | Belanger | 52/645 |
| 2004/0250486 | A1 * | 12/2004 | Sibbett | 52/204.1 |
| 2006/0254153 | A1 * | 11/2006 | Clancy | 49/501 |
| 2009/0025320 | A1 * | 1/2009 | Wagner et al. | 52/217 |
| 2009/0077912 | A1 * | 3/2009 | Yeremian | 52/217 |

* cited by examiner

DOOR SEALING DEVICE AND RELATED METHODS

CROSS REFERENCE TO RELATED APPLICATION

This present application claims the benefit of the filing date of U.S. Provisional Patent Application 61/243,732 entitled "Door Sealing Device and Related Methods" to John Brogan which was filed on Sep. 18, 2009, the contents of which are hereby incorporated herein by reference.

BACKGROUND

1. Field of the Invention

The disclosure relates generally to door seal adapter kits and more specifically to an adjustable horizontal adapter bar door sealing kit configured for addition to storm, security and screen doors.

2. Description of Related Art

Conventional storm doors, security doors and screen doors for buildings include a metal frame that forms an outside boundary of the door. Home construction, however, often leaves a door jamb not sized to a correct height for a particular door, leaving a gap below the door through which bugs, small animals and debris can enter even when the door is closed.

SUMMARY

The present disclosure provides a first aspect relating to a door for an entrance to a building, the door comprising a door frame comprising a bottom edge with at least two openings in the bottom edge, a horizontal adapter bar comprising an adjustable length, a first end and a second end, and at least one vertical bar coupled to each of the first and second ends, the vertical bars each having a top end sized to fit within a corresponding opening of the at least two openings in the bottom edge of the door frame, and at least two fasteners, wherein the horizontal adapter bar is mounted to the door frame by inserting the top ends of the vertical bars into the at least two openings in the bottom edge of the door frame and securing the vertical bars to the door frame with at least one fastener of the at least fasteners through the door frame into at least one of the vertical bars on each of the first and second end of the horizontal adapter bar.

Particular implementations may comprise one or more of the following. The door frame may be a door frame is a door frame of one of a security door, a storm door and a screen door. A threshold plate and bug sweep may be coupled to the door frame and at least partially overlapping the horizontal adapter bar. The horizontal adapter bar may comprise a horizontal adapter bar and the door frame may comprise a horizontal frame bar, wherein the horizontal adapter bar is substantially parallel to the horizontal frame bar. The horizontal adapter bar may comprise at least two horizontal adapter bars telescoped one inside the other. The vertical bars each comprise a length of less than about 5 inches. The at least one vertical bar coupled to each of the first and second ends may comprise at least a first vertical bar and a second vertical bar coupled to each of the first and second ends, wherein the first vertical bar may be fixedly coupled to its respective first or second end and the second vertical bar may be removably coupled to its respective first or second end. The first vertical bar may be fixedly coupled using a first weld of a first weld strength, and the second vertical bar may be removably coupled using a second weld of a second weld strength less than half of the first weld strength.

In another aspect, a kit for modifying a door for an entrance to a building may comprise a horizontal adapter bar comprising an adjustable length adjustable to a width of the door for which the kit is designed, the horizontal adapter bar further comprising a first end and a second end, at least one vertical bar coupled to each of the first end and the second end, the first and second vertical bars each comprising a top end sized to fit within a corresponding opening in a bottom edge of a door frame of the door for which the kit is designed, and at least two fasteners each capable of extending through a wall of the door frame and at least a portion of the first vertical bar or a portion of the second vertical bar.

Particular implementations may comprise one or more of the following. A threshold plate and bug sweep may be configured for coupling to the door frame such that it at least partially overlaps the horizontal adapter bar. The horizontal adapter bar may comprise at least two horizontal adapter bars telescoped one inside the other. The vertical bars may each comprise a length of less than about 5 inches. The at least one vertical bar coupled to each of the first and second ends may comprise a first vertical bar fixedly coupled to the first end, a second vertical bar fixedly coupled to the second end, a third vertical bar removably coupled to the first end, and a fourth vertical bar removably coupled to the second end. At least two expansion vertical bars may each have a bar width corresponding to a width of at least one of the at least one vertical bar, the at least two expansion vertical bars may each comprise a fastener surface at which the expansion vertical bars may be fastened to the at least two vertical bars. The fastener surface may comprise a welding surface. The fastener surface may comprise a screw mounting surface.

In another aspect, a method of adapting an existing door in an entrance to a building may comprise adjusting a length of a horizontal adapter bar to match a width of a door frame for an existing door in an entrance to a building, inserting each of at least two vertical bars respectively coupled to first and second ends of the horizontal adapter bar into corresponding openings in a bottom edge of the door frame, adjusting the extent to which the at least two vertical bars are inserted into the corresponding openings in relation to a threshold of the building adjacent to the door, and fastening the horizontal adapter bar to the door frame by inserting at least two fasteners through the door frame, at least one into each of the at least two vertical bars.

Particular implementations may comprise one or more of the following. Adjusting a width of the at least two vertical bars prior to inserting the at least two vertical bars into the corresponding openings. Adjusting a width of the at least two vertical bars comprises removing a portion of the at least two vertical bars or adding expansion vertical bars. Covering at least a portion of a gap that previously existed between the door frame and the threshold with the horizontal adapter bar. The adjusting, inserting and fastening may be performed while the door frame is mounted to the entrance to the building.

Aspects and applications of the inventions presented here are described below with reference to the Drawings and the Detailed Description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶ 6. Thus, the use of the words "function," "means" or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶ 6. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present inventions may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present inventions may be practiced without these specific details. In other instances, known structures and devices are shown or discussed more generally in order to avoid obscuring the inventions. In many cases, a description of the operation is sufficient to enable one to implement the various forms of the inventions. It should be noted that there are many different and alternative configurations, devices and technologies to which the disclosed inventions may be applied. The full scope of the inventions is not limited to the examples that are described below.

Figure 1:
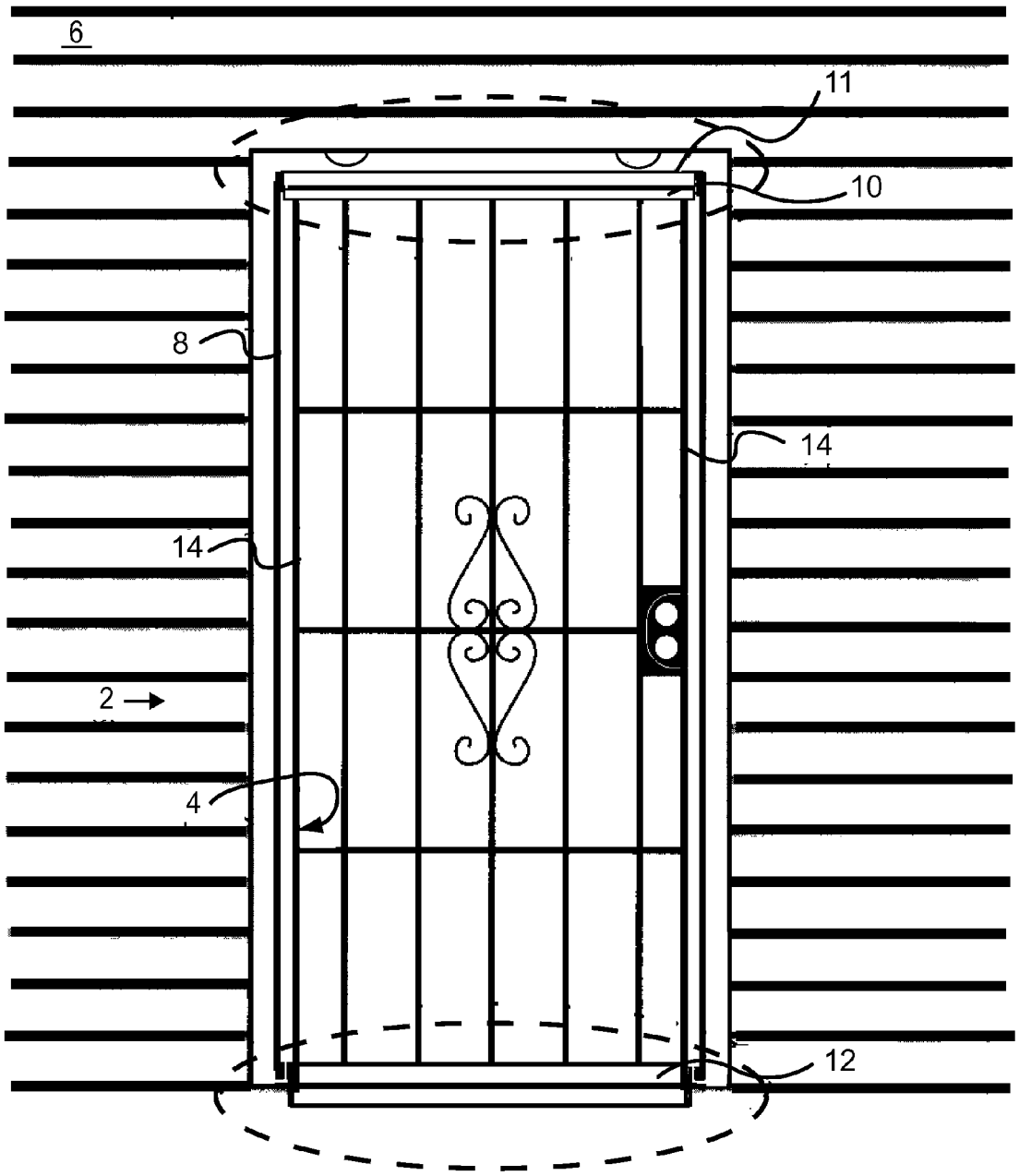
FIG. 1 illustrates a front view of a door to an entrance to a building according to a particular implementation.
Figure 2A:
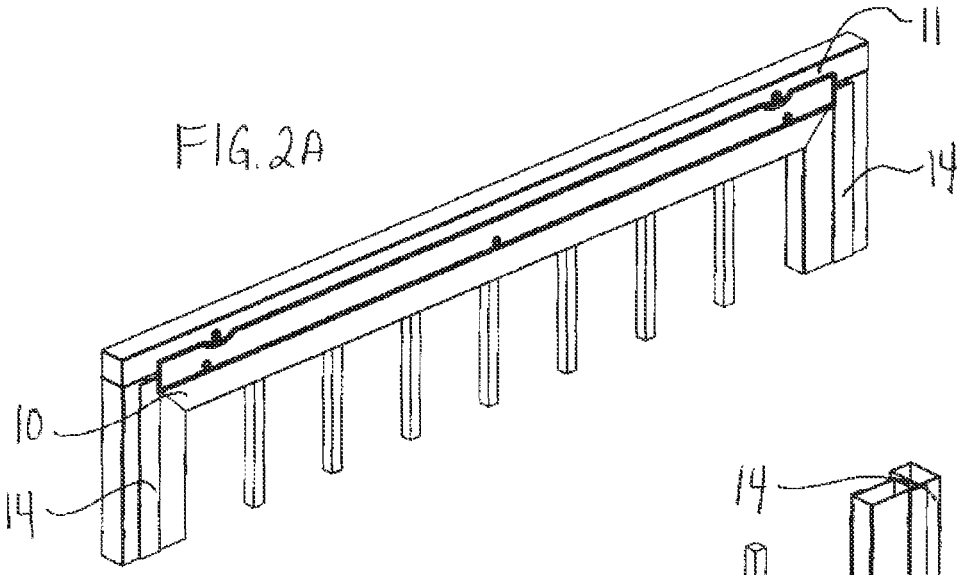
FIG. 2A illustrates a top seal plate of the door of FIG. 1.

FIG. 1 below illustrates a door 2 comprising a door frame 4 such as is typical with security doors, safety doors, screen doors and storm doors known in the industry. The door frame 4 is mounted into a wall 6 of a building by mounting the door frame 4 into a door jamb 8. The door frame 4 of these types of doors 2 is often made of hollow metal tubing, such as steel or aluminum tubing. The door frame 4 includes a top edge 10 and a top seal plate 11, and a bottom edge 12, with supporting side edges 14 extending between the top edge 10 and bottom edge 12 to form the door frame 4 (see also FIGS. 2A and 2B). Because the door frame 4 is typically installed into a door jamb 8 to match the top of the door jamb 8, unless the building wall 6 was very closely constructed to a standard door height or the door and door jamb was custom made for the opening in the wall.

Figure 2B:
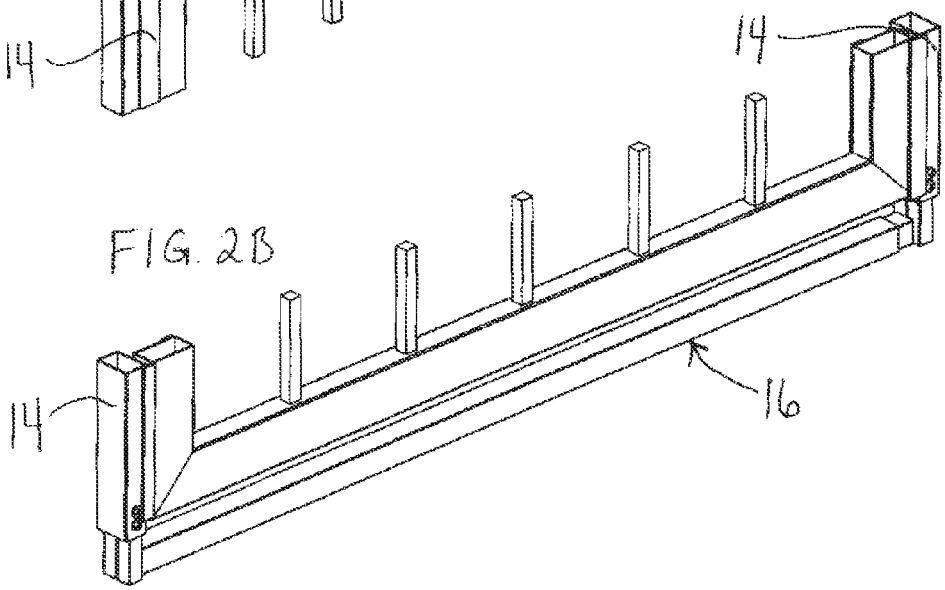
FIG. 2B illustrates a horizontal adapter bar on a bottom of the door of FIG. 1.
Figure 3A:
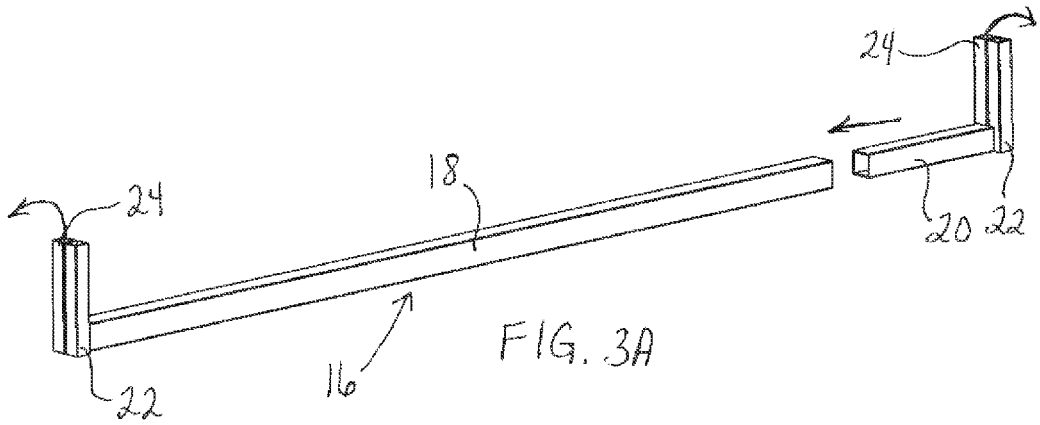
FIG. 3A illustrates portions of a telescoping adjustable horizontal adapter bar.

FIG. 2B also illustrates an adjustable horizontal adapter bar 16 mounted to the bottom edge of the door frame 4 by inserting it into the hollow tubing of the door frame 4 side support 14. FIG. 3A illustrates a particular implementation of an adjustable horizontal adapter bar 16 comprising first and second (or more) horizontal bars 18 and 20, one (or more) telescoped inside of the other(s), to allow for the horizontal adapter bar 16 to have an adjustable length yet still maintain its structural strength. The particular respective lengths of the first and second horizontal bars 18 and 20 and the number of horizontal bars that form the adjustable horizontal adapter bar 16 is not critical, but those of ordinary skill in the art will readily be able to adjust the lengths to appropriate lengths and numbers for a particular door width given the disclosure provided here. Nevertheless, if in a particular implementation the adjustable horizontal adapter bar 16 is too long for a particular door width, the first horizontal bar 18 may be trimmed an additional amount to shorten the assembled adjustable horizontal adapter bar 16 to a desired length less than its previous length. Because the second horizontal bar 20 telescopes inside the first horizontal bar 18, appropriate trimming of an end of the first horizontal bar 18 will not limit its telescoping use.

Figure 2C:
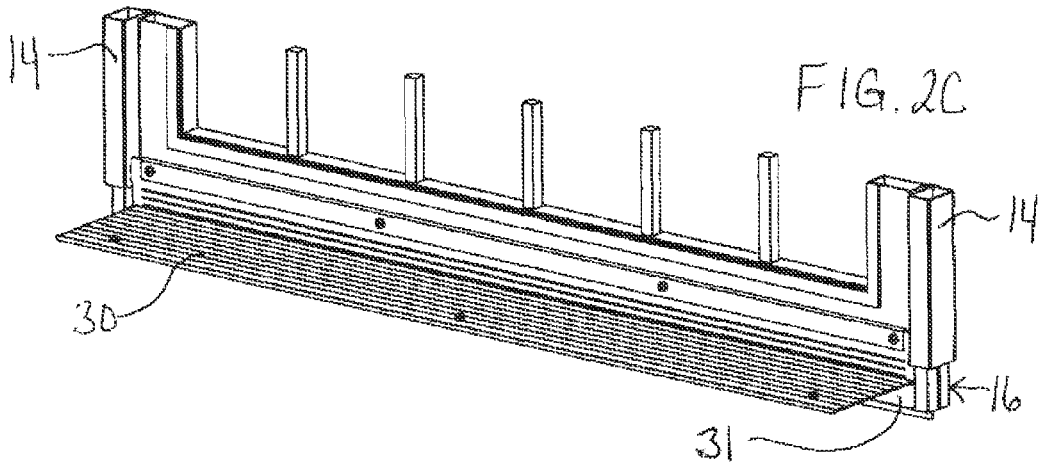
FIG. 2C illustrates the horizontal adapter bar on the bottom of the door of FIG. 2B with a threshold plate and bug sweep attached.
Figure 3B:
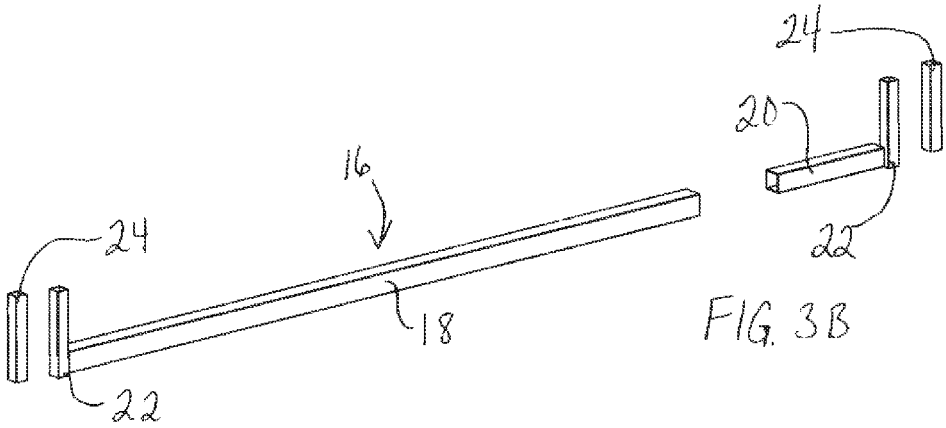
FIG. 3B illustrates the telescoping adjustable horizontal adapter bar of FIG. 3A with a set of vertical bars detached.

As further illustrated in FIGS. 3A and 3B, at least one vertical bar 22 may be coupled to each of remote ends of the adjustable horizontal adapter bar 16. The vertical bars 22 may be coupled through fasteners such as screws or welding, or through any other way known to the industry. For an adapter kit for a typically installed door, the vertical bars 22 should be about 5 inches or less, and generally about 4 inches or less, to allow for sufficient adjustment of length. In the particular implementation illustrated in FIGS. 3A and 3B, a second vertical bar 24 is coupled to each of the first vertical bars 22 as a vertical bar width adjustment. The second vertical bar 24 may be coupled to the first vertical bar 22 in many ways including, but not limited to, welding, adhesive, screws and other fasteners known in the industry. Coupling may be directly to the first vertical bar 22, or indirectly through the adjustable horizontal adapter bar 16. If welding is used, it is specifically contemplated that the second vertical bars 24 may be removable from the adjustable horizontal adapter bar 16 to adjust the width of the vertical bars and the size of opening in the door bottom edge into which the end of the vertical bars fits by making a weld that attaches the second vertical bars 24 less than half as strong as the weld that attaches the first vertical bars 22 such that with some prying force by an installer, the second vertical bars 24 may be removed without removing the first vertical bars 22. In particular implementations, such as that illustrated in FIG. 2C, a threshold plate 31 and/or bug sweep 30, which may be manufactured as a common component or separate components, may be coupled to the door frame 4 after, or before, mounting of the adjustable horizontal adapter bar 16. For example, but without limitation, the threshold plate 31 may be coupled to the door frame 4 through the adjustable horizontal adapter bar 16 and the bug sweep 30 may be coupled to the door frame 4 through a support bar at the bottom edge of the door frame 4.

Figure 4:
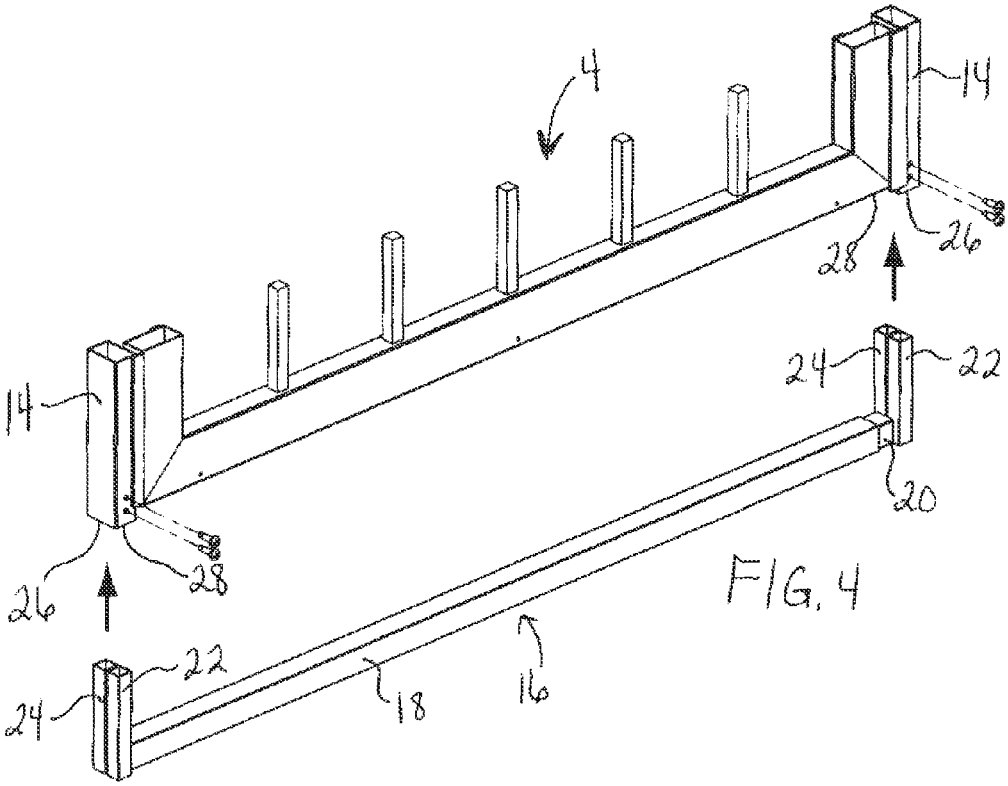
FIG. 4 illustrates coupling of a horizontal adapter bar to a door frame.

FIG. 4 specifically illustrates the mounting inserting of each of the at least two vertical bars 22 into openings 26 in the bottom surface 28 of the door frame 4 through the ends of the side supports 14 of the door frame 4. In particular implementations, like that illustrated in FIG. 4, the bottom support bar (not shown) of the door frame 4 is removed prior to inserting the adjustable horizontal adapter bar 16 such that the adjustable horizontal adapter bar 16 replaces the bottom support bar and the bottom edge of the door frame is defined without the bottom support bar. In other particular implementations, the adjustable horizontal adapter bar 16 mounts below the bottom support bar of the door frame 4 and the bottom of the door frame is defined as the bottom edge of the bottom support bar. In implementations where an adjustable length horizontal adapter bar is used, the length of the horizontal adapter bar 16 is adjusted to match a width of the door frame 4 to which it is being adapted.

Figure 5:
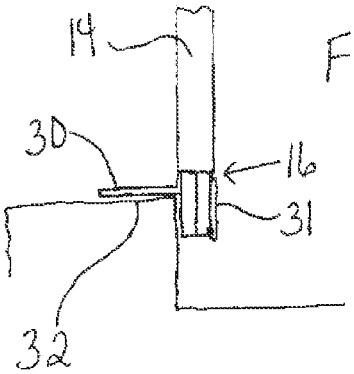
FIG. 5 illustrates a side view of an assembled door frame showing the threshold and its relation to the horizontal adapter bar.

When the vertical bars 22 and possibly 24, are inserted into the openings 26 in the bottom surface 28 of the door frame 4, the depth to which the vertical bars are inserted into the corresponding openings 26 is adjusted by the installer in relation to a threshold 32 of the building adjacent to the door. FIG. 5 illustrates an example of how the adjustable horizontal adapter bar 16 may be selectively positioned in relation to the threshold 32. After the appropriate positioning of the adjustable horizontal adapter bar is decided, the installer may secure the adjustable horizontal adapter bar 16 in place with a fastener, such as a self-drilling screw, a one way screw, a pin, a weld, adhesive, or other fastener known in the industry. In particular implementations, holes may be pre-drilled for fasteners in one or both of the side support bars 14 and/or the vertical bars 22. When a screw or pin is used, the fastener extends through the wall of the support bar 14 into the vertical bar 22, for example, as shown in FIGS. 4 and 2B. Multiple fasteners may be used on either side of the door frame 4 for additional security.

The adjustable horizontal adapter bar 16 fills at least a portion of a gap that previously existed between the bottom edge of the door frame 4 and the threshold 32 of the building. In implementations where a threshold plate 31 and/or bug sweep 30 are used in combination with the adjustable horizontal adapter bar 16, the combination of the two can further restrict bugs, small animals and debris from entering between the door and the threshold and can reduce drafts, thereby lowering energy costs, minimizing outside noise and may create other benefits associated with creating a seal or barrier between the bottom of the door and the threshold. In other particular implementations, an adjustable horizontal adapter bar may be used in association with a top plate 11 (FIG. 2A) of a door frame 4 to create a better fitting barrier at the top of the door as well.

When a security door is installed, manufacturer instructions typically instruct the installer to install the door with one-way screws so that the door can function as a security door (if they were not one-way screws anyone could just remove the screws to remove the door). Because of the use of one-way screws, the door cannot be removed to modify it without damaging the frame. By sizing the vertical legs so that they are less than or equal to approximately 4 inches long, and in some cases not longer than 5 inches, implementations of an adjustable horizontal adapter bar can be retrofit in place of an existing bar on a security door without uninstalling the door. In other words, the retrofit bar can be installed while the door remains hanging in place.

An adjustable horizontal adapter bar may be sold as a kit which may further include a top seal plate, threshold plate, bug sweep and the relevant screws and instructions. When sold as a kit, the components allow a home owner or handyman to install a door seal/barrier on new storm/security doors or other appropriate door or to retrofit an existing storm/security door or other appropriate door on a home or business to include a door seal/barrier. To install the components, a user determines whether the door frame tube size is a standard size or small size, and if small remove one of the vertical legs on the kit bottom bar, adjusts the length of the adjustable horizontal adapter bar and inserts the vertical legs into the openings at the bottom of the door to install the adjustable horizontal adapter bar. Set screws are placed in the door frame to hold the adjustable horizontal adapter bar in place. The threshold plate may be coupled to the adjustable horizontal adapter bar at the appropriate height, and the bug sweep is coupled to the bottom of the door at a height that it sweeps the threshold plate when it is closed to restrict entry of bugs and dust.

It will be understood that implementations are not limited to the specific components disclosed herein, as virtually any components consistent with the intended operation of the various implementations may be utilized. Accordingly, for example, it should be understood that, while the drawing figures accompanying text show and describe particular embodiments and implementations, components may comprise any shape, size, style, type, model, version, class, grade, measurement, concentration, material, weight, quantity, and/or the like consistent with the intended operation of methods and/or system implementations.

The concepts disclosed herein are not limited to the specific implementations shown herein. For example, it is specifically contemplated that the components included in particular implementations may be formed of any of many different types of materials or combinations that can readily be formed into shaped objects and that are consistent with the intended operation of the implementations. For example, the components may be formed of: rubbers (synthetic and/or natural) and/or other like materials; polymers and/or other like materials; plastics, and/or other like materials; composites and/or other like materials; metals and/or other like materials; alloys and/or other like materials; and/or any combination of the foregoing.

Furthermore, embodiments may be manufactured separately and then assembled together, or any or all of the components may be manufactured simultaneously and integrally joined with one another. Manufacture of these components separately or simultaneously, as understood by those of ordinary skill in the art, may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular implementations, it should be readily apparent that a number of modifications may be made without departing from the spirit thereof and that these implementations may be applied to other implementations disclosed or undisclosed. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A security, storm, safety or screen door for an entrance to a building comprising:

a door frame comprising a bottom edge, a top edge opposite the bottom edge, a first side edge and a second side edge each coupled to the bottom edge and the top edge, and a bottom surface that extends from the first side edge to the second side edge, the bottom surface comprising a first opening proximate a first bottom end and a second opening proximate a second bottom end, the second bottom end opposite the first bottom end;

an adjustable length horizontal adapter bar removably coupled to the door frame and comprising:

a first adapter end and a second adapter end opposite the first adapter end;

a first vertical bar coupled to the first adapter end and comprising a top end removably coupled within the first opening; and a second vertical bar coupled to the second adapter end of the adapter bar and comprising a top end removably coupled within the second opening;

a first fastener extending through the door frame and the first vertical bar and a second fastener extending through the door frame and the second vertical bar; and a threshold plate and a bug sweep each coupled to the door frame and at least partially overlapping the horizontal adapter bar.

2. The door of claim 1, wherein the door frame is selected from the group consisting of a security door frame, a storm door frame and a screen door frame.

3. The door of claim 1, wherein the horizontal adapter bar comprises a telescoping horizontal adapter bar.

4. The door of claim 1, wherein the vertical bars each comprise a length of less than about 5 inches.

5. The door of claim 1, further comprising a third vertical bar removably coupled to the first adapter end and a fourth vertical bar removably coupled to the second adapter end, wherein the first vertical bar is fixedly coupled to the first adapter end and the second vertical bar is fixedly coupled to the second adapter end.

6. The door of claim 5, wherein the first vertical bar is fixedly coupled to the first adapter end using a first weld of a first weld strength, the second vertical bar fixedly coupled to the second adapter end, the third vertical bar is removably coupled to the first adapter end using a second weld of a second weld strength less than half of the first weld strength, and the fourth vertical bar is removably coupled to the second adapter end.

7. A kit for modifying a door for an entrance to a building to include a security, storm, safety or screen door, the kit comprising:

a telescoping horizontal adapter bar comprising a length adjustable to a width of the door, the horizontal adapter bar further comprising a first adapter end and a second adapter end;

a first vertical bar coupled to the first adapter end and a second vertical bar coupled to the second adapter end, the first and second vertical bars each comprising a top end sized to fit within a corresponding opening in at least one of a top edge and a bottom edge of a door frame of the door;

at least two fasteners each capable of extending through a wall of the door frame and at least a portion of the first vertical bar or a portion of the second vertical bar; and a threshold plate and a bug sweep configured for coupling to the door frame and at least partially overlapping the horizontal adapter bar when coupled to the door frame.

8. The kit of claim 7, wherein the first and second vertical bars each comprise a length of less than about 5 inches.

9. The kit of claim 7, further comprising a third vertical bar removably coupled to the first adapter end and a fourth vertical bar removably coupled to the second adapter end, wherein the first vertical bar is fixedly coupled to the first end and the second vertical bar is fixedly coupled to the second adapter end.

10. The kit of claim 9, wherein the first vertical bar is fixedly coupled to the first adapter end using a first weld of a first weld strength, the second vertical bar is fixedly coupled to the second adapter end, the third vertical bar is removably coupled to the first adapter end using a second weld of a second weld strength less than half of the first weld strength, and the fourth vertical bar is removably coupled to the second adapter end.

11. A kit for modifying a door for an entrance to a building to include a security, storm, safety or screen door, the kit comprising:

a telescoping horizontal adapter bar comprising a length adjustable to a width of the door, the horizontal adapter bar further comprising a first adapter end and a second adapter end;

a first vertical bar coupled to the first adapter end and a second vertical bar coupled to the second adapter end, the first and second vertical bars each comprising a top end sized to fit within a corresponding opening in at least one of a top edge and a bottom edge of a door frame of the door;

at least two fasteners each capable of extending through a wall of the door frame and at least a portion of the first vertical bar or a portion of the second vertical bar; and a third vertical bar removably coupled to the first adapter end and a fourth vertical bar removably coupled to the second adapter end, wherein the first vertical bar is fixedly coupled to the first end and the second vertical bar is fixedly coupled to the second adapter end.

12. The kit of claim 11, wherein the first vertical bar is fixedly coupled to the first adapter end using a first weld of a first weld strength, the second vertical bar is fixedly coupled to the second adapter end, the third vertical bar is removably coupled to the first adapter end using a second weld of a second weld strength less than half of the first weld strength, and the fourth vertical bar is removably coupled to the second adapter end.

* * * * *